US010626544B2

(12) United States Patent
Kim et al.

(10) Patent No.: US 10,626,544 B2
(45) Date of Patent: Apr. 21, 2020

(54) DRYING MACHINE

(71) Applicant: LG Electronics Inc., Seoul (KR)

(72) Inventors: Chungil Kim, Seoul (KR); Namyeong Heo, Seoul (KR)

(73) Assignee: LG Electronics Inc., Seoul (KR)

( * ) Notice: Subject to any disclaimer, the term of this patent is extended or adjusted under 35 U.S.C. 154(b) by 831 days.

(21) Appl. No.: 15/064,690

(22) Filed: Mar. 9, 2016

(65) Prior Publication Data

US 2016/0265153 A1 Sep. 15, 2016

(30) Foreign Application Priority Data

Mar. 9, 2015 (KR) ..... 10-2015-0032706
Mar. 9, 2015 (KR) ..... 10-2015-0032707

(51) Int. Cl.
*D06F 58/28* (2006.01)
*D06F 58/26* (2006.01)

(52) U.S. Cl.
CPC ..... *D06F 58/28* (2013.01); *D06F 58/263* (2013.01); *D06F 2058/289* (2013.01); *D06F 2058/2819* (2013.01); *D06F 2058/2829* (2013.01); *D06F 2058/2861* (2013.01)

(58) Field of Classification Search
CPC ..... D06F 58/28; D06F 2058/289; D06F 2058/2861; D06F 58/263; D06F 2058/2819; D06F 2058/282; D06F 2058/2829
See application file for complete search history.

(56) References Cited

U.S. PATENT DOCUMENTS 3,718,982 A 3/1973 Deaton
4,733,479 A * 3/1988 Kaji ..... D06F 58/28 34/446
5,347,727 A * 9/1994 Kim ..... D06F 58/28 34/491
2006/0150437 A1 7/2006 Tarnowski et al.
2011/0153086 A1 6/2011 Bellinger

FOREIGN PATENT DOCUMENTS

CN 1510206 7/2004
CN 1300407 2/2007
CN 100360735 1/2008
CN 100387770 5/2008
(Continued)

OTHER PUBLICATIONS

Extended European Search Report issued in European Application No. 16159338.9 dated Jul. 27, 2016, 10 pages.
(Continued)

*Primary Examiner* — Jessica Yuen
(74) *Attorney, Agent, or Firm* — Fish & Richardson P.C.

(57) ABSTRACT

A drying machine may include a drum configured to accommodate clothes, a fan motor configured to generate a flow of air, a heater configured to heat the air, a modulator configured to adjust a quantity of heat provided by the heater, and a user interface configured to provide a manager menu to correct a difference between a current quantity of heat caused by adjustment of the modulator and a target quantity of heat generated by variation in the modulator, where the modulator may include a device configured to manually set a maximum pressure and a minimum pressure.

10 Claims, 9 Drawing Sheets

(56) References Cited

FOREIGN PATENT DOCUMENTS

| | | |
|---|---|---|
| CN | 103161057 | 6/2013 |
| CN | 103361950 | 10/2013 |
| CN | 103835108 | 6/2014 |
| EP | 1433894 | 6/2004 |
| JP | 2940199 | 8/1999 |
| KR | 10-2005-0015708 | 2/2005 |
| KR | 10-2005-0018035 | 2/2005 |
| KR | 10-0480929 | 4/2005 |
| KR | 10-0583242 | 5/2006 |
| KR | 10-1114206 | 2/2012 |
| KR | 10-2013-0064268 | 6/2013 |
| KR | 10-2013-0111164 | 10/2013 |
| KR | 10-1337662 | 12/2013 |
| KR | 1020120075898 | 12/2013 |
| KR | 10-2014-0065263 | 5/2014 |

OTHER PUBLICATIONS

Chinese Office Action in Chinese Application No. 201610133000.8, dated May 30, 2018, 13 pages.

* cited by examiner

DRYING MACHINE

This application claims the benefit of Korean Patent Application Nos. 10-2015-0032707 filed on, Mar. 9, 2015 and 10-2015-0032706 filed on Mar. 9, 2015, each of which is hereby incorporated by reference as if fully set forth herein.

BACKGROUND

A drying machine is a household appliance that dries clothes by supplying hot air into a drum where the clothes are accommodated. Drying machines may also be used for commercial purposes.

A commercial drying machine may be a drying machine that several users can use by paying a charge. The charge for using the drying machine may be paid whenever the users use the drying machine, or the drying machine usage charge may be included in maintenance costs in a place, for example, a dormitory.

The management of a drying time and energy usage is very important for a drying machine. This is because the drying machine is used by a large number of persons, but a small amount of power usage is desired to ensure the supplier makes profit.

SUMMARY OF THE INVENTION

According to one aspect, a method of controlling a drying machine may include a first load decision step for determining, based on variation in a temperature of air discharged from a drum, whether a load of clothes accommodated in the drum is a small load, a medium load, or a large load, wherein the variation in temperature of air is sensed by a temperature sensor and hot air is supplied to the drum by driving of the drum, a heater, and a fan motor, a second load decision step for determining whether the load is a small load or an extremely small load using a dryness sensor provided in the drum while the supply of hot air and the driving of the drum has been stopped, the second load decision step being selectively performed after the first load decision step based on the load being determined to be the small load in the first load decision step, and a drying step for performing drying based on the load determined in the first load decision step or the second decision step.

Implementations according to this aspect may include one or more of the following features. For example, during the drying step, based on the load being determined to be large, a supply target quantity of heat of the heater and a target RPM value of the fan motor are controlled to be greater than the quantity of heat of the heater and a target RPM value of the fan motor based on the load being determined to be small, where the supply quantity of heat of the heater and the RPM value of the fan motor are controlled to be constant in the drying step based on the load being determined to be a small load and an extremely small load, and where the supply quantity of heat of the heater and the RPM value of the fan motor are controlled to vary in the drying step based on the load being determined to be a medium or large load. The control method may include an initial temperature sensing step for sensing a temperature using the temperature sensor before the first load decision step, where the driving of the heater is stopped and the fan motor and the drum are driven in the initial temperature sensing step. The first load decision step is performed based on the initial sensed temperature in the initial temperature sensing step being a predetermined temperature or lower than the predetermined temperature, where the initial temperature sensing step is repeated for a predetermined time based on the initial sensed temperature in the initial temperature sensing step exceeding the predetermined temperature, and where while the initial temperature sensing step is repeated, the first load decision step is performed based on the initial sensed temperature being the predetermined temperature or lower, and the first load decision step is not performed and the second load decision step is performed based on the initial temperature exceeding the predetermined temperature. The initial temperature sensed during first load decision step is categorized into any of a plurality of temperature ranges. In the first load decision step the load is determined to be the medium or large load based on the temperature sensed by the temperature sensor for a first set time being lower than a first reference temperature, which is higher than an upper limit temperature of the corresponding temperature range, and the second load decision step is omitted, where, based on the temperature sensed by the temperature sensor within the first set time being the first reference temperature or higher, the control method further comprises a step of calculating a rate of increase of the temperature sensed by the temperature sensor from a point in time to determine whether the load is the small load or is the medium or large load, wherein, based on the rate of increase of the temperature being determined to be high or low based on whether the sensed temperature reaches a second reference temperature, which is higher than the first reference temperature, within a second set time, and where the load is determined to be the small load based on the rate of increase of the temperature being higher than a threshold temperature, and the load is determined to be the medium or large load based on the rate of increase of the temperature being lower than the threshold temperature.

In each temperature range, a difference between the second reference temperature and the first reference temperature is reduced as the temperature range is increased, and the second set time is a set time period. The first load decision step includes a RPM setting step for setting the RPM of the fan motor to an increased value. The RPM stetting step is performed to increase the RPM in a stepwise manner. The supply quantity of heat of the heater is controlled to be maximum in the first load decision step. The control method may include a duct blockage sensing step for sensing duct blockage using an airflow switch, wherein the duct blockage sensing step is eliminated in the first load decision step and the second load decision step, and is performed in performing the drying step. The control method may include a cooling step for supplying cold air into the drum by driving the drum and the fan motor after the drying step ends, and where the fan motor is controlled to be operated at a previous RPM in cooling step.

According to another aspect, a drying machine may include a drum configured to accommodate clothes, a fan motor configured to generate a flow of air, a heater configured to heat the air, a modulator configured to adjust a quantity of heat provided by the heater, and a user interface configured to provide a manager menu that is manipulated by a user to correct a difference between a current quantity of heat caused by adjustment of the modulator and a target quantity of heat generated by variation in the modulator, where the modulator includes a device configured to manually set a maximum pressure and a minimum pressure.

Implementations according to this aspect may include one or more of the following features. For example, the heater is a gas burner, and the modulator is a gas valve, where the modulator is configured to adjust an opening rate to adjust a pressure of gas supplied to the gas burner, and where the modulator is configured to adjust a voltage or current value applied to either end of a connection terminal to adjust the pressure of gas between the maximum pressure and the minimum pressure. The drying machine may include a controller configured to perform control to apply a voltage or current value, corresponding to the target quantity of heat to the modulator based on a current dry state, where the correction of the difference is performed by correcting a lookup table including a combination of the target quantity of values and the voltage or current value corresponding to the target quantity of heat, and where the correction of the difference is performed as the voltage or current value corresponding to the target quantity of heat is reduced by a predetermined decrement based on the opening rate of the modulator being greater than a reference value, and as the voltage or current value corresponding to the target quantity of heat is increased by a predetermined increment based on the opening rate of the modulator being smaller than the reference value.

According to another aspect, a drying machine may include a drum configured to accommodate clothes, a drum motor configured to drive the drum, a fan motor provided separately from the drum motor, and configured to generate flow of air, an exhaust flow path configured to allow air discharged from the drum to be discharged outward, a temperature sensor configured to sense a temperature of the air discharged from the drum, a dryness sensor provided in the drum and that is configured to sense dryness based on a frequency of contact with the clothes, an airflow switch configured to sense a block in the air flow path, a heater configured to heat the air, and a controller configured to determine whether a load of the clothes is a small load, a medium load, or a large load, based on a temperature value sensed by the temperature sensor, and to determine whether the load of the clothes is a small load or an extremely small load based on a value sensed by the dryness sensor, wherein the controller is configured to control g the drum motor, the fan motor, and the heater to perform drying at different quantities of heat and different flow rates of air based on the determined load size.

Implementations according to this aspect may include one or more of the following features. For example, the controller is configured to determine the load size in each of a plurality of temperature ranges based on an initial temperature sensed by the temperature sensor. The controller determines that the load is a small load based on the initial temperature exceeding an upper limit value of the temperature range and is higher than the upper limit value for a predetermined time. Based on the load being determined to be a medium load or large load, the controller does not determine whether the load is a small load or an extremely small load.

DETAILED DESCRIPTION

Figure 1:
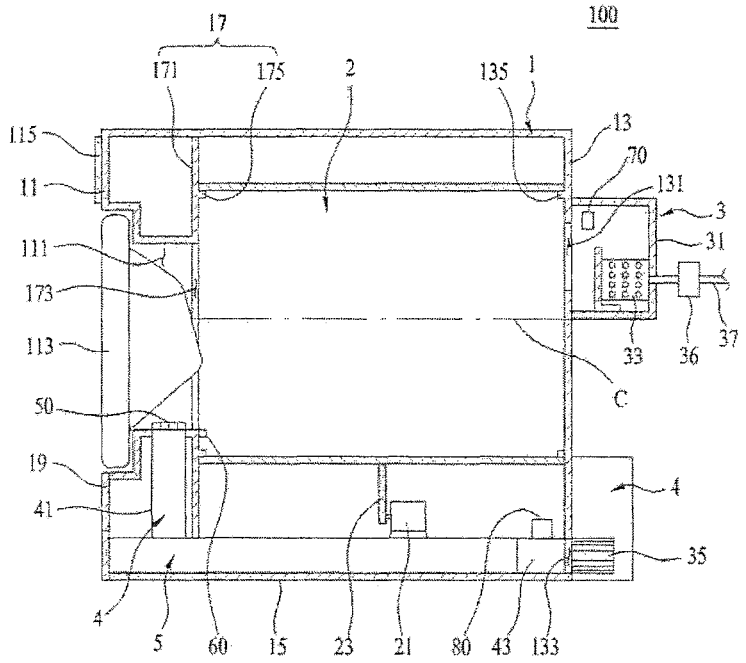
FIG. 1 is a sectional view of an example of a drying machine.

As illustrated in FIG. 1, a drying machine 100 may include a cabinet 1, which defines the external appearance of the drying machine, a drum 2, which is rotatably provided inside the cabinet 1 and accommodates laundry, an air supply unit 3, which supplies heated air (hot air) or unheated air (cold air) into the drum 2, an exhaust flow path 4, through which air inside the drum 2 is discharged to the outside of the drum 2, and a filter assembly 5, which removes impurities from the air to be discharged from the drum 2.

The cabinet 1 may include a front panel 11 having an opening 111, a rear panel 13 having an air inlet port 131, which communicates with the interior of the drum 2, and a base panel 155, which supports the front panel 11 and the rear panel 13 and is located below the drum 2. In addition, the cabinet 1 may include a side panel.

A user may introduce or remove laundry into or from the drum 2 through the opening 111. The opening 111 may be opened or closed by a door 113, which is rotatably coupled to the front panel 11.

The front panel 11 may be provided with a control panel 115, and the control panel 115 may include an input unit, which inputs a control command to the drying machine, and a display unit, which displays details of the control of the drying machine. One example of the control panel 115 will be described later with reference to FIG. 9.

The rear panel 13 is provided opposite the front panel 11 to face the front panel 11. The air inlet port 131 is formed through the rear panel 13 to allow the air supplied from the air supply unit 3 to be introduced into the drum 2.

The rear panel 13 may have an air outlet port 133, through which the air, discharged from the drum 2 through the exhaust flow path 4, moves to the outside of the cabinet 1.

In addition, the rear panel 13 may further include a rear support flange 135, which rotatably supports the rear surface of the drum 2. The base panel 15 serves to assist the drying machine 100 in being supported on the ground surface. The front panel 11 and the rear panel 13 are secured to the base panel 15.

A drum support unit 17 is additionally provided inside the cabinet 1 and serves to rotatably support the front surface of the drum 2. The drum support unit 17 includes a support body 171 fixed inside the cabinet 1, and an aperture 173 formed in the support body 171 so as to communicate the opening 111 with the interior of the drum 2.

As such, the laundry, introduced into the cabinet 1 through the opening 111, may be moved into the drum 2 through the aperture 173 of the drum support unit 17.

In addition, the drum support unit 17 may further include a front support flange 175, which rotatably supports the front surface of the drum 2. The front support flange 175 is formed along the outer circumference of the support unit aperture 173.

In some examples, based on the diameter of the drum 2, the diameter of the front support flange 175 may be greater than the diameter of the support unit aperture 173.

The drum 2 may take the form of a cylinder, the front surface and the rear surface of which are open. As described above, the front surface of the drum 2 is rotatably supported by the front support flange 175 and the rear surface of the drum 2 is rotatably supported by the rear support flange 135.

The drum 2 is rotated by a drum drive unit. The drum drive unit may include a drum motor 21, and a belt 23, which connects a rotating shaft of the drum motor 21 and the outer circumferential surface of the drum 2 to each other. When the drum motor is driven, the drum is rotated.

The air supply unit 3 serves to supply heated air or unheated air into the drum 2 to cause heat exchange between the laundry and the air. The air supply unit 3 may include a heater housing 31 provided on the rear panel 13, a heater (i.e. heating device) 33 provided within the heater housing 31, and a fan motor 35 provided in or near the exhaust flow path 4. In this way, as the fan motor 35 is driven to suction outside air, the air flows through a housing inlet port 311, the air inlet port 131, the drum 2, a connection duct 41, the filter assembly 5, and an exhaust duct 43 in sequence. That is, the fan motor 35 may be configured to suction the outside air through the elements mentioned above, and thereafter to discharge the air to the outside through the exhaust flow path 4.

The heater housing 31 is configured to surround the air inlet port 131 formed in the rear panel 13, and further includes the housing inlet port 311, through which the air is introduced into the heater housing 31.

The reason why the heater housing 31 is located outside the cabinet 1, rather than being located inside the cabinet 1, is to realize the drying of bulky laundry.

As the amount of laundry increases, it is necessary to supply a greater amount of air into the drum 2 in order to dry the laundry within a given time. Therefore, the drying machine, which is devised to dry bulky laundry, may need to increase the amount of air supplied to the drum 2, and may also require a high capacity heater (heating device), which may heat a great amount of air.

However, when providing the high capacity heater inside the cabinet 1, the external size of the cabinet 1 may be increased, and the temperature inside the cabinet 1 may increase due to the high capacity heater, which may cause damage to inner elements of the drying machine.

The air supply unit 3 may include the heater 33 of a gas burner type, in order to supply high-temperature heat. A gas burner type heater may be used rather than an electric heater. The air supply unit 3 may include a gas pipe 37. In addition, a modulator 36 may be provided to control the pressure of gas supplied to the heater 33. As the pressure of gas supplied to the heater 33 increases, higher temperature heat may be provided.

The exhaust flow path 4, as described above, serves to discharge the air inside the drum 2 to the outside of the cabinet 1. The exhaust flow path 4 may include the connection duct 41 provided in the height direction of the drum 2 (i.e. the direction perpendicular to the rotation axis C of the drum 2), and the exhaust duct 43 provided in the longitudinal direction of the drum 2 so as to discharge the air supplied from the connection duct 41 to the outside of the cabinet 1. The fan motor 35 may be located in or near the exhaust duct 43.

The connection duct 41 is located below the opening 111 (in front of the support unit aperture 173) and serves to move the air inside the drum 2 to the exhaust duct 43. The exhaust duct 43 may serve to connect the connection duct 41 and the air outlet port 133 to each other such that the air discharged from the drum 2 is discharged to the outside of the cabinet 1 through the connection duct 41. In this case, the fan motor 35 included in the air supply unit 3 may be secured to the exterior of the cabinet 1 so as to suction the air inside the exhaust duct 43.

Although a high flow rate of hot air is necessary in order to dry bulky laundry, installing a large capacity fan within the cabinet 1 having a limited size is not easy.

Therefore, when the fan motor 35 is secured to the rear panel 13 as illustrated in FIG. 1 to discharge the air inside the drum 2 through the air discharge port 133, the installation of the large capacity fan is possible without variation in the size of the cabinet 1.

The filter assembly 5, included in the drying machine 100 may be provided in the direction parallel to the rotation axis C of the drum 2 (i.e. in the longitudinal direction of the drum 2) to filter the air discharged from the drum 2. The filter assembly 5 may be separably coupled to the exhaust duct 43, rather than the connection duct 41, so as to filter the air discharged from the drum 2.

In some examples a filter is provided in the connection duct 41. The length of the connection duct 41 cannot vary so long as the size of the drying machine 100 is not varied, and therefore it is difficult to expand the filtering capacity of the filter.

The drying machine 100 may remarkably increase the filtering capacity of the filter assembly 5 because the filter assembly 5 is provided in the exhaust duct 43, which is provided in the longitudinal direction of the drum 2 (i.e. in the direction parallel to the rotation axis C of the drum 2).

Accordingly, the drying machine 100 may be utilized as a commercial drying machine that requires rapid drying of laundry and drying of bulky laundry.

The filter assembly 5 may be provided to be separably coupled to the exhaust duct 43, and the front panel 11 may be provided with a filter support panel 19.

An exhaust grill 50 may be provided on the top of the connection duct 41. The exhaust grill 50 has a mesh form and prevents large impurities or clothes from entering the connection duct 41. The exhaust grill 50 is generally formed of a plastic material.

As described above, in the case of an extremely small load, the situation in which clothes block the exhaust grill 50 may frequency occur. The flow path of air is blocked, which may cause thermal damage to constituent elements due to the overload and temperature increase of the fan motor 35. In particular, the exhaust grill 50 may be deformed due to thermal damage.

In order to sense the blockage of the flow path of air, an airflow sensor 70 may be provided. The airflow sensor 70 may be located in the heater housing 31. When the flow path of air is blocked, a negative pressure inside the heater housing 31 increases. The airflow sensor 70 may sense the increased negative pressure, thereby judging that the flow path of air is blocked.

The blockage of the flow path of air may occur at various positions such as, for example, the connection duct 41, the filter assembly 5, and the exhaust flow path 4, as well as the exhaust grill 50.

The drying machine 100 may be referred to as an exhaust type drying machine. The drying machine may be a drying machine that discharges air used to remove moisture from clothes outward. Thus, when the temperature of air to be discharged is excessively high, this means that excessive drying is performed and additionally means that power is unnecessarily consumed. Hence, it is important to sense the temperature of air to be discharged, in order to appropriately control the quantity of heat and/or the flow rate of air.

The drying machine 100 may include a temperature sensor 80. In particular, the temperature sensor 80 may be provided so as to sense the temperature of air discharged from the drum 2. The temperature sensor 80 may be provided in the exhaust flow path 4. In particular, the temperature sensor 80 may be provided in or near the exhaust duct 43. The temperature sensor 80 may easily sense the temperature environment around the drying machine 100 and may also easily sense the temperature environment inside the drying machine 100. In particular, the temperature sensor 80 may also sense whether the drying machine was very recently operated or whether a long time has passed since the drying machine 100 was operated. Accordingly, through the temperature sensor 80, an initial environment factor may be applied when the drying machine 100 begins operation. This initial environment factor may be very important for load sensing, which will be described below.

There may be provided various devices that determine the drying progress during the course of drying, for example, a device that senses dryness. In one example, a dryness sensor may be provided, which senses dryness using the frequency of contact with wet laundry inside the drum and/or the content of moisture in the laundry. The dryness sensor may be an electrode sensor, and may sense dryness using an output value, which is proportional to the frequency of contact and/or the content of moisture, for example, the magnitude of resistance.

The dryness sensor 60 may be provided inside the drum 2, and in particular, may be provided below the drum 2. The load sensing may be performed via the dryness sensor 60. In particular, as will be described below, the load sensing may be very important for sensing a very small load, i.e. an extremely small load.

The drying machine 100 includes a controller 10, which controls various control elements of the drying machine 100.

The controller 10 may be provided so as to control whether or not to operate the drum motor 21 and to control the operational RPM of the drum motor 21. In addition, the controller 10 may control a user interface 200. The controller 10 may control the operation of the drying machine 100 based on information input via the user interface 200. The user interface 20 may be provided to allow the user to input various commands to the drying machine 100, and may be provided to provide the user with various information regarding the drying machine 100.

The controller 10 may control the operation of the drying machine 100 using information regarding the blockage of the flow path of air sensed by the airflow switch (AFS) 70. In addition, upon receiving the information regarding the blockage of the flow path of air, the controller 10 may provide the user with error information via the user interface 200.

The controller 10 may control the operation of the drying machine 100 based on the temperature sensed by the temperature sensor 80. The controller 10 may be provided so as to control whether or not to operate the fan motor 35 and to control the operational RPM of the fan motor 35. When the fan motor 35 is operated, hot air or cold air is supplied into the drum 2. In addition, when the operational RPM is increased, the flow rate of hot air or cold air to be supplied may be increased.

Figure 2:
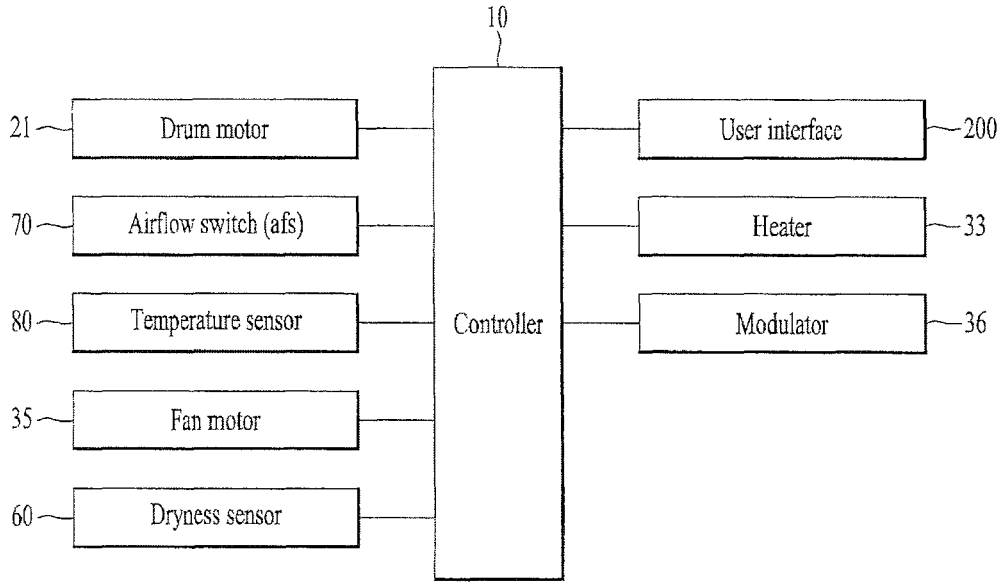
FIG. 2 is a control block diagram of the example drying machine.

The drum motor 21 and the fan motor 35, as illustrated in FIG. 2, may be separately provided. As such, the driving of the drum 2 and the flow of air may be controlled independently of each other. The flow of air may be forcibly generated even when the drum 2 is not driven, and that the flow of air may stop when only the drum is driven. The controller 10 may control the on/off operation of the heater 33. In addition, the controller 10 may control the quantity of heat supplied from the heater 33. When the heater 33 is a gas burner type heater, the control in the quantity of heat may be performed by controlling the pressure of gas supplied to the heater 33. The modulator 36 may be provided, and the controller 10 may control the quantity of heat by controlling the modulator 36.

The modulator 36 may vary the pressure of gas in proportion to a current value or voltage value input to the electric modulator. For example, the pressure of gas may vary as the opening rate of the electric modulator varies. The electric modulator may be a linearly controllable electric modulator. For example, the opening rate of the electric modulator is increased as the current applied to either end of the modulator is increased, which may increase the pressure of gas supplied to the heater 33.

The maximum opening position and the minimum opening position of the modulator 36 may be mechanically set. The opening rate of the modulator 36 may be adjusted as the current applied thereto is increased or decreased between the maximum opening position and the minimum opening position. The pressure of gas may be adjusted via adjustment in the opening rate of the modulator.

Figure 3:
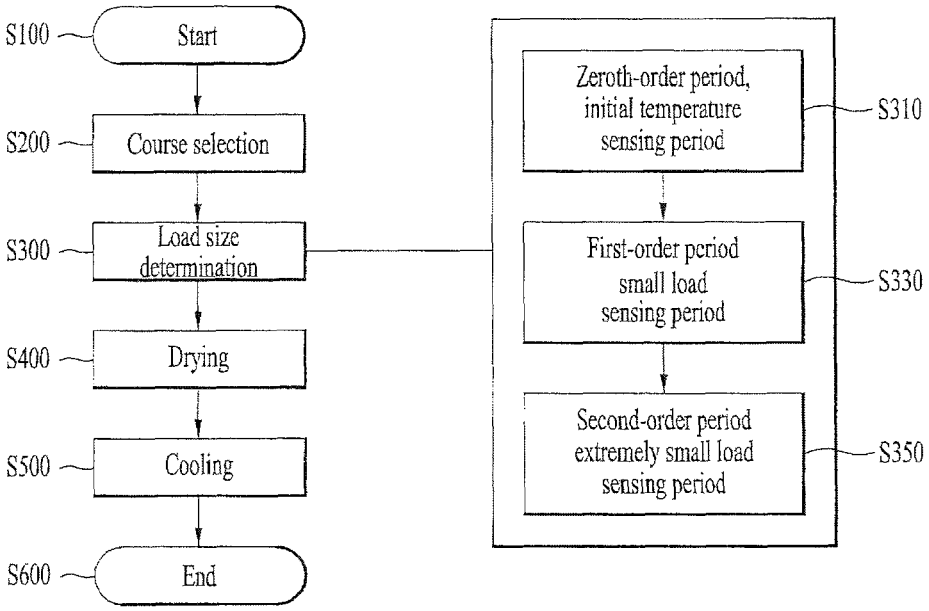
FIG. 3 is a flowchart illustrating a control method of the drying machine.

As described in FIG. 3, the drying machine 100 may begin a drying operation by applying power or paying a charge (S100).

The user selects any one of a plurality of drying courses (S200). The drying machine 100 may perform load size determination S300 in order to differently perform the selected course based on the load size. In the course selection, any one of a plurality of drying courses may be selected. For example, a drying course may be selected based on the material of clothes to be dried. For example, the drying courses may be divided based on the quantity of heat supplied to the clothes. A high temperature course may be selected to dry heavy and rugged clothes such as jeans, a medium temperature course may be selected to dry general casual clothes, a low temperature course may be selected to dry synthetic fiber clothes, and a hot air exclusion course may be selected to dry plastic or rubber clothes.

When the course selection S200 and the load size determination S300 are completed, the controller performs drying S400 based on the determined load size and the selected course. The drying S400 may generally be performed by supplying hot air. The quantity of heat and the flow rate of hot air may be controlled differently based on the selected course. Of course, the drying S400 may be performed by supplying only cold air in the case of the hot air exclusion course.

When the drying S400 is completed, cooling S500 may be performed by supplying cold air to the clothes. The cooling S500 serves to perform additional drying and to cool constituent elements of the drying machine, such as the drum, or clothes.

When the cooling S500 ends, the operation of the drying machine 100 ends (S600).

It is general to perform the operation of the drying machine 100 in the sequence of the course selection 200, the drying S400, and the cooling S500. The load size determination S300 may be performed before the drying S400, to vary the control pattern of the quantity of heat and the flow rate of hot air during the drying S400 based on the determined load size. In addition, a load determination operation may be basically performed multiple times in order to accurately perform the load size determination S300.

For example, the load size determination S300 may basically include at least two load size determination operations so as to finally determine the size of a load. A preceding load size determination operation is not an operation of determining the final load, but a prerequisite operation of performing a subsequent load size determination operation.

The control method of the drying machine in accordance with the present embodiment may include a primary load size determination operation S330 of determining whether the load is tentatively a small load, or a medium or large load. In the primary load size determination operation S330, whether the load is a medium or large load may ultimately be determined, and whether the load is a tentatively small load may be determined. Upon determining that the load is tentatively a small load, this means a determination suspension state in which the load may or may not ultimately be a small load, or may be an extremely small load.

For example, a medium or large load may be a load that exceeds 3 kg. A small load may be a load that is 3 kg or less. In addition, among small loads, a load that is 1 kg or less may be an extremely small load. The reference for categorizing loads may vary based on, for example, the size of the drying machine, the thermal capacity of the heater, and the size of the drum.

Accordingly, in one example, a load that is ultimately determined to be a medium or large load may be a load that exceeds 3 kg, a small load may be a load that is 1 kg or more but below 3 kg, and an extremely small load may be a load that is below 1 kg. Accordingly, when a small load is tentatively determined, a final operation of determining that the load is a small load or an extremely small load may follow.

The reason why a medium or large load is discriminated from a small load is to reduce power consumption attributable to the supply of excessive heat. In addition, the reason why an extremely small load is discriminated from a small load is to prevent the excessive quantity of heat and thermal damage. In addition, this serves to minimize the blockage of the exhaust grill 50 in the case of an extremely small load.

In the primary load size determination operation S330 described above, the fan motor is driven while the drum is driven. That is, hot air is supplied into the drum. In addition, clothes in the drum may be tumbled by the driving of the drum. While the drum is driven and the hot air is supplied, the temperature of air discharged from the drum is sensed via the temperature sensor 80. Through variation in temperature, whether the load of clothes accommodated in the drum 2 is tentatively a small load, or a medium or large load is determined.

When the load is determined to be medium or large in the primary load size determination operation S330, the load may ultimately be determined to be a medium or large load. A subsequent load size determination operation may be omitted, and the drying 400 may be directly performed. In this way, it is possible to prevent an increase in the operating time of the drying machine 100 attributable to an unnecessary load size determination operation.

When the small load is tentatively determined in the primary load size determination operation S330, a secondary load size determination operation S350 of ultimately determining whether the load is a small load or an extremely small load may be performed. Thus, the secondary load size determination operation S350 may be selectively performed.

In the secondary load size determination operation S350, the supply of hot air stops and the drum may be driven. The stoppage of the supply of hot air may be the same as the stoppage of heat and hot air. Accordingly, the heater 33 and the fan motor 35 may stop driving, and only the drum motor 21 may be driven.

Here, stopping the operation of the fan motor 35 serves to prevent the clothes from moving to the exhaust grill 50 due to the flow of air. In addition, this serves to cause the clothes moved to the exhaust grill 50 in the primary load size determination operation S330 to be separated from the exhaust grill 50. The drum may be driven at this time. The clothes may be separated from the exhaust grill 50 by being moved inside the drum only via the driving of the drum without the flow of air.

Because the secondary load size determination operation S350 tentatively presupposes a small load, it is sufficient to determine whether the load is an extremely small load or not. When the load is not an extremely small load, this is because the load is determined to be a load having a size intermediate to an extremely small load and a medium or large load.

When the load is an extremely small load, there is a high possibility of the clothes being introduced to the exhaust grill 50 in the primary load size determination operation S330. In addition, the volume of the extremely small load, which occupies the interior of the drum, is very small. In the state in which only the drum is driven, the frequency at which the extremely small load comes into contact with the dryness sensor (e.g. a humidity sensor or an electrode sensor) is very small. Thus, whether the load is an extremely small load may be determined based on a value sensed by the dryness sensor 60.

Accordingly, whether the load is ultimately an extremely small load or a small load may be determined in the secondary load size determination operation S350.

In the control method of the drying machine the load is ultimately determined based on values sensed by different sensors in at least two load size determination operations, therefore more accurate load size determination is possible. In addition, because a plurality of load size determination operations is not always performed, it is possible to prevent an unnecessary increase in the operating time of the drying machine 100. In particular, in the case of a medium or large load, which requires the longest drying time, it is possible to prevent the operating time of the drying machine 100 from being increased by the secondary load size determination operation S350 because only the primary load size determination operation S330 is performed.

The secondary load size determination operation S350 may be controlled to be performed only for a fixed amount of time. In one example, the secondary load size determination operation S350 may be controlled to be performed only during a fixed amount of time regardless of whether the load is an extremely small load or a small load. The fixed amount of time may be, for example, one minute. The secondary load size determination operation S350 is performed for the fixed amount of time of 1 minute, to ultimately determine whether the load is an extremely small load or a small load. It is possible to prevent the operating time of the drying machine from being excessively increased via the implementation of the secondary load size determination operation S350.

Once the load size has been determined, the drying 400 may be performed by supplying different temperatures and flow rates of hot air. Of course, this may be the same in the cooling S500. However, in the case of the cooling S500, it may not consume much power and may be performed for a relatively short time. Accordingly, the flow rate of cold air during the cooling S500 may be constant regardless of the load size.

In the primary load size determination operation S330 described above, the load size is determined based on variation in the temperature of air discharged from the drum. However, variation in the temperature of air is affected by the load size as well as the initial temperature.

For example, under the same load, when the initial temperature of the drying machine 100 is very low, the increase in temperature may be greater than that when the initial temperature of the drying machine 100 is very high. That is, when the initial temperature of the drying machine 100 is low, the temperature of the air discharged from the drum may be rapidly increased via the supply of heat. As such, the determination of load size may be affected by the initial temperature of the drying machine 100.

The initial temperature of the drying machine 100 may vary based on, for example, the temperature of the location at which the drying machine 100 is placed, seasonal variation, or whether the drying machine 100 was used very recently or a long time ago. For example, when the drying machine 100 is again operated after drying stops prior to implementing cooling in a high temperature environment, the initial temperature may be very high. In this case, assuming the same load, the increase in temperature must be smaller than when the initial temperature is very low. The primary load size determination operation S330 may be performed in consideration of the initial temperature. In other words, in order to reduce load size determination errors attributable to variation in initial temperature, the control method may include an initial temperature sensing operation S310. The initial temperature sensing operation S310 may be performed first during the load size determination S300.

That is, when the course selection S200 is completed, the controller 10 receives an initial temperature value via the temperature sensor 80. At this time, the subsequent load size determination operations are performed based on the received temperature value.

The initial temperature sensing operation S310 serves to sense the initial environment of the drying machine 100, and the driving of the heater 33 is eliminated. In addition, the fan motor 35 and the drum motor 21 are driven. When a predetermined time (e.g. 5 seconds) has passed since the start of the initial temperature sensing operation S310, the initial temperature is sensed via the temperature sensor 80. The predetermined time may be required to more accurately sense the initial temperature of the drying machine 100 via the driving of the drum and the supply of cold air.

The initial temperature sensing operation S310, the primary load size determination operation S330, and the secondary load size determination operation S350 may be performed in sequence during successive periods as needed. These periods may respectively be referred to as a zeroth-order period, a first-order period, and a second-order period.

Figure 4:
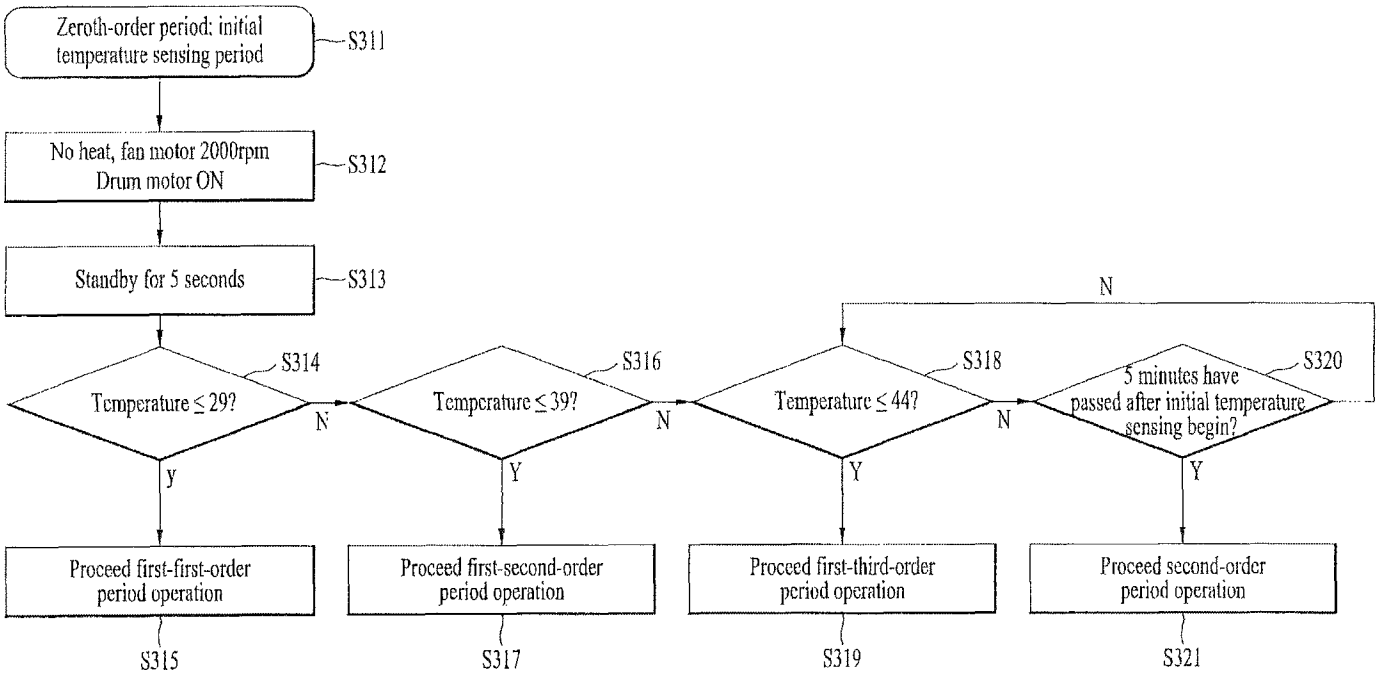
FIG. 4 is a flowchart of one example of an initial temperature sensing operation illustrated in FIG. 3.

As illustrated in FIG. 4, when the initial temperature sensing period begins (S311), an operation of creating an environment for sensing the initial temperature is performed (S312). In this operation, the supply of heat is eliminated and the supply of cold air is controlled. Then, the drum is controlled so as to be driven. The heater 33 is controlled to be turned off, the fan motor 35 is controlled so as to be turned on, and the drum motor 21 is controlled to be turned on. In addition, the fan motor 35 may be set to, for example, 2000 RPM so that the flow rate of hot air becomes a medium or high level. The initial temperature is sensed while a standby operation is performed for a prescribed time (S313) after the environment creation operation S312 begins. That is, the initial temperature of the drying machine 100 is sensed via the temperature sensor 80.

Operations S314, S316, S318 and S320 of categorizing the sensed initial temperature into one of a plurality of temperature ranges are implemented. The number of temperature ranges may be, for example, four.

First, an operation of determining whether the initial temperature falls within a lowest temperature range of 29 degrees Celsius or lower may be performed (S314). 29 degrees Celsius is a temperature similar to room temperature, and may represent the most general initial temperature. Thus, the value of 29 degrees Celsius may be replaced with any other value. When the initial temperature is 29 degrees Celsius or lower, the initial temperature sensing operation ends (S315), and the primary load size determination operation S330 that corresponds to this temperature range begins (S331).

When the initial temperature exceeds 29 degrees Celsius, an operation of determining whether the initial temperature is 39 degrees Celsius or lower may be performed (S316). 39 degrees Celsius may represent a very hot environment or may indicate the amount of time that has passed since the operation of the drying machine 100 ended. Thus, the value of 39 degrees Celsius may be replaced with any other value. When the initial temperature is equal to or less than 39 degrees Celsius, the initial temperature sensing operation ends (S317), and the primary load size determination operation S330 that corresponds to this temperature range begins (S331).

When the initial temperature exceeds 39 degrees Celsius, an operation of determining whether the initial temperature is 44 degrees Celsius or lower may be performed (S318). 44 degrees Celsius may represent the state immediately after the operation of the drying machine 100 ends or the state when the drying machine 100 is temporarily stopped during drying. Thus, the value of 44 degrees Celsius may be replaced with any other value. When the initial temperature is equal to or less than 44 degrees Celsius, the initial temperature sensing operation ends (S319), and the primary load size determination operation S330 that corresponds to this temperature range begins (S331').

When the initial temperature exceeds 44 degrees Celsius, the temperature is reduced during a prescribed time, and it is determined whether the temperature is equal to or less than 44 degrees Celsius. That is, whether the prescribed time has passed is determined (S320), and when the temperature, reduced during the prescribed time, is not lower than 44 degrees Celsius, the initial temperature sensing operation ends (S321), and the primary load size determination operation S330 is omitted. That is, the primary load size determination operation S330 is not performed, and the second load size determination operation S350 begins directly (S351). Then, when the temperature is reduced to or below 44 degrees Celsius before the prescribed time has passed, the primary load size determination operation S330 that corresponds to a temperature range of 44 degrees Celsius or lower begins (S331").

Here, the prescribed time may be, for example, 5 minutes. The prescribed time may be set to a time that ensures a sufficient reduction in the temperature of a medium or large load while cold air is supplied. That is, when the temperature is not reduced to, for example, 44 degrees Celsius or lower even after cold air is supplied during a prescribed time, this means that the load is not great. When the load is a medium or large load, the load contains a great amount of moisture, and therefore the temperature of air discharged from the drum may be rapidly reduced.

Therefore, when the temperature is not reduced to within a set temperature range during the prescribed time, the load is tentatively determined to be a small load. Of course, the initial temperature sensing operation is repeated during the prescribed time (S320). That is, the initial temperature is continuously sensed, and it is determined whether the sensed temperature is a predetermined temperature or lower.

When the initial temperature is the predetermined temperature (e.g. 44 degrees Celsius) or lower, the primary load size determination operation S330 may be performed. Then, when the initial temperature is not reduced to the predetermined temperature or lower within the predetermined time (e.g. 5 minutes), the primary load size determination operation S330 is omitted, and the secondary load size determination operation S350 may be performed.

The initial temperature sensing operation S310 may be an operation of providing a precondition for optimally determining the initial temperature and/or load via variation in the initial temperature. That is, the initial temperature sensing operation S310 may be an operation of categorizing the initial temperature into any of a plurality of ranges and determining the load size by applying different criteria based on the categorized ranges. In addition, the initial temperature sensing operation S310 may be an operation capable of clearly determining that the initial temperature is not a temperature corresponding to a medium or large load. That is, when the initial temperature is not reduced to the predetermined temperature during the predetermined time, it is determined that the load is clearly not a medium or large load, the subsequent primary load size determination operation is omitted, and the secondary load size determination operation may be performed directly. Accordingly, the initial temperature sensing operation may be referred to as a zeroth-order load size determination operation.

Figure 5:
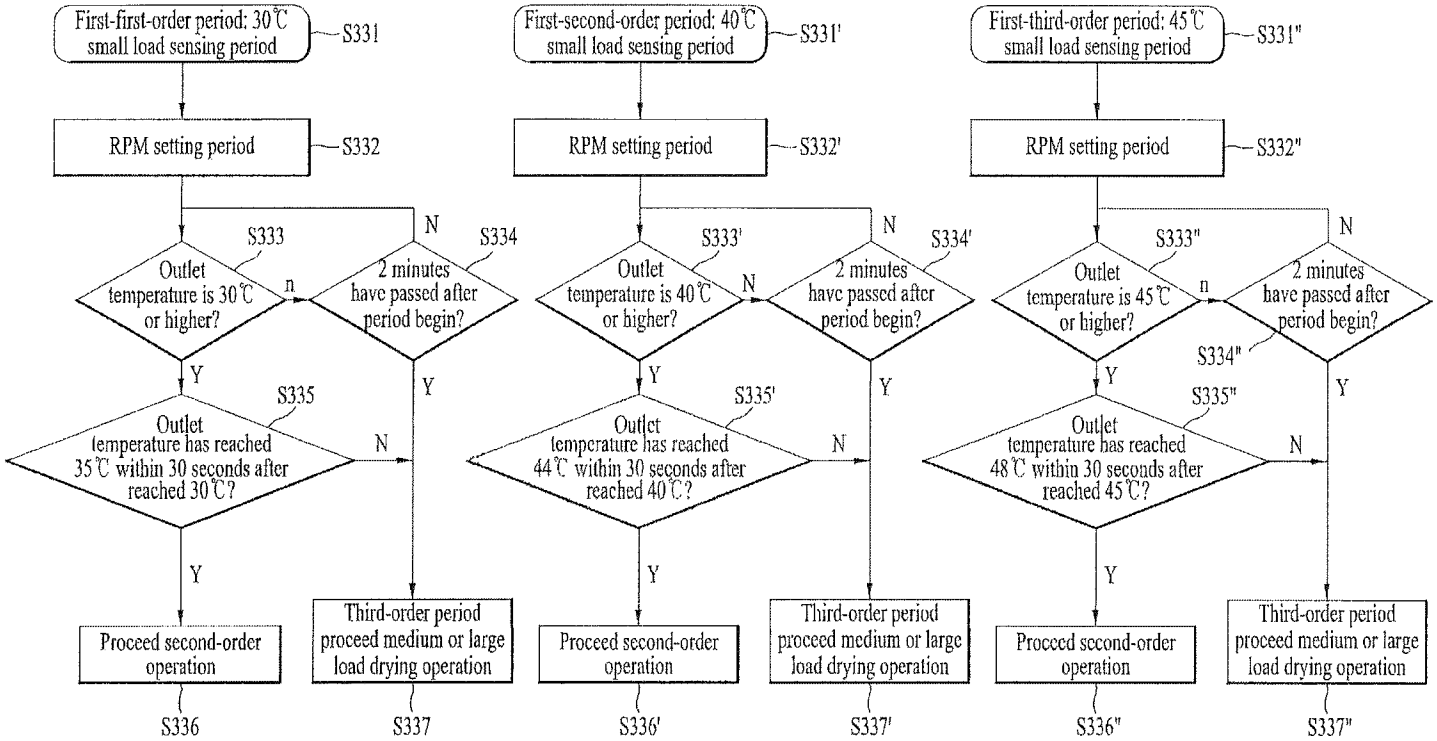
FIG. 5 is a flowchart of one example of a primary load size determination operation illustrated in FIG. 3.

As illustrated in FIG. 5, the primary load size determination operation S330 will be described based on a first temperature range, for example, a range in which the initial temperature is 29 degrees Celsius or lower.

When the primary load size determination operation S330 begins (S331), RPM setting S332 may be performed. At this time, heat may be supplied, and the fan motor 35 may be controlled such that the flow rate of air becomes the same as in the zeroth-order load size determination operation. Here, the quantity of heat may be maximum. For example, the heater 33 and the modulator 36 may be controlled so that the quantity of heat becomes 5500 Btu/h.

The primary load size determination operation S330 may be the period during which load size determination and initial drying are performed. The maximum heat is initially supplied to reduce the drying time during subsequent drying S.

Through the supply of hot air, in the primary load size determination operation S330, the temperature of air discharged from the drum increases. However, the temperature increase rate, i.e. the temperature gradient varies based on the load size. When the load is a medium or large load, the temperature increase rate is relatively low. When the load is an extremely small load or a small load, the temperature increase rate is relatively high. The temperature increase rate may be calculated in various ways. The temperature increase rate may be calculated based on the temperature increase during a prescribed time, or may be calculated based on the amount of time taken to effect a prescribed temperature increase. Of course, it is not necessary to calculate the absolute temperature increase rate, and the temperature increase rate may be determined from a reference value that enables a determination of whether or not the load is a medium or large load.

In one example, the upper limit of the temperature range may be 29 degrees Celsius, which is within the temperature range of 29 degrees Celsius or lower. Thus, the temperature of air discharged from the drum may increase when the hot air is supplied. At this time, a reference temperature, i.e. a first reference temperature may be 30 degrees Celsius. A first reference temperature, higher than the upper limit of the corresponding temperature range, for example, a first reference temperature that is higher by 1 degree Celsius may be set.

It is determined whether the temperature sensed by the temperature sensor 80 after the RPM setting S332 is the first reference temperature or higher (S333). In addition, when the sensed temperature is not the first reference temperature or higher, it is determined whether a first set time has passed since the primary load size determination operation S330 began (S334). In one example, the first set time may be set to 2 minutes. When the sensed temperature is not the first reference temperature or higher until after the first set time has passed, this means that the load size is sufficiently large. Thus, in this case, the load is determined to be a medium or large load (S337), and the drying S400 is performed. Of course, this drying may be drying based on the medium or large load.

When the temperature sensed by the temperature sensor 80 after the RPM setting S332 is the first reference temperature or higher, it is determined whether the temperature reaches a second set temperature within a second set time (S335). Here, the second set time may be, for example, 30 seconds, and the second set temperature may be 3 degrees Celsius higher than the first set temperature. The difference between the first set temperature and the second set temperature may be set to 5 degrees Celsius. That is, it is determined whether an increase of 5 degrees Celsius has been achieved within the second set time. When an increase of 5 degrees Celsius is achieved within the second set time, a sufficiently large temperature increase rate is confirmed, and thus the load is tentatively determined to be a small load. Conversely, when an increase of 5 degrees Celsius within the second set time is not achieved, a small temperature increase is determined, and thus the load may be determined to be a medium or large load.

At this time, upon tentatively determining that the load is a small load, the secondary load sensing operation of additionally determining whether the load is an extremely small load begins (S336). In addition, upon determining that the load is a medium or large load, the secondary load size determination operation S350 may be omitted and drying may be immediately performed. Of course, this drying may be drying based on the medium or large load.

As in the case of the temperature range in which the initial temperature is 29 degrees Celsius or lower, whether the load is a medium or large load, or is a tentatively small load is determined in the same manner even in the temperature range in which the initial temperature is 39 degrees Celsius or lower and the temperature range in which the initial temperature is 44 degrees Celsius or lower. That is, operations S331' to S337', or operations S331" to S337" are performed in the same manner as operations S331 to S337.

However, the difference between the first reference temperature and the second reference temperature may be reduced as the upper limit of the temperature range is increased. In one example, when the upper limit of the temperature range is 39 degrees Celsius, the difference between the first reference temperature of 40 degrees Celsius and the second reference temperature of 44 degrees Celsius may be 4 degrees Celsius. In addition, when the upper limit of the temperature range is 44 degrees Celsius, the difference between the first reference temperature of 45 degrees Celsius and the second reference temperature of 48 degrees Celsius may be 3 degrees Celsius.

The difference between the first reference temperature and the second reference temperature may be set so as to be reduced as the upper limit of the temperature range is increased. This is because the temperature increase rate is gradually reduced under the assumption of the same load and the supply of the same quantity of heat as the initial temperature is increased. In one example, it is determined in operation S335 whether the temperature increases by 5 degrees Celsius, it is determined in operation S335' whether the temperature increases by 4 degrees Celsius, and it is determined in operation S335" whether the temperature increases by 3 degrees Celsius.

Accordingly, it is possible to reduce load size determination errors attributable to the initial temperature because the initial temperature is categorized into one of a plurality of temperature ranges and the load is a tentatively small load or a medium or large load. That is, more accurate load size determination is possible regardless of the initial temperature.

The second set time may be the same regardless of the upper limit of the temperature range. Thus, it is possible to minimize deviation of the required time in the primary load size determination operation S330 regardless of the upper limit of the temperature range. However, because the primary load size determination operation S330 is an operation of distinguishing a tentatively small load from a medium or large load, the required time may vary based on the absolute size of the load. For example, in the case of an extremely small load of 1 kg, after the primary load size determination operation S330 is performed, and the load may tentatively be determined to be a small load after, for example, 30 seconds have passed. In the case of an extremely small load of 2.5 kg, after the primary load size determination operation S330 is performed, the load may tentatively be determined to be a small load after, for example, 22 seconds have passed. In the case of a medium or large load of 5 kg, after the primary load size determination operation S330 is performed, the load may be determined to be a medium or large load after, for example, 2 minutes and 30 seconds have passed.

Figure 6:
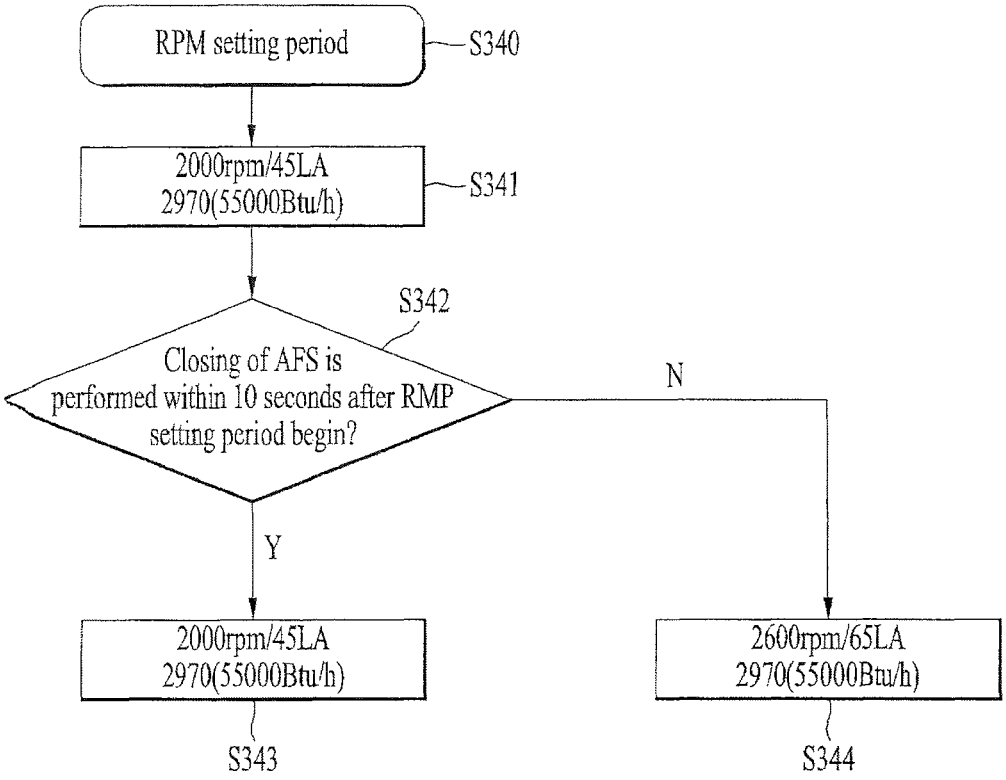
FIG. 6 is a flowchart of one example of an RPM setting operation illustrated in FIG. 5.

The RPM setting operation may be performed in the above-described primary load size determination operation S330. As illustrated in FIG. 6, when the RPM setting operation begins (S341), the RPM of the fan motor 35 may be set to a medium flow rate or more, for example, 2000 RPM. Here, the maximum RPM of the fan motor 35 may be, for example, 3000 RPM. In addition, the maximum quantity of heat may be controlled to, for example, 5500 Btu/h. That is, the drying and load size determination may be more effectively performed at an initial relatively high flow rate and maximum quantity of heat.

After the RPM of the fan motor 35 is set, whether or not a blockage occurs is sensed via the airflow switch 70 (S342). The case where it is determined that a blockage has occurred or that there is a risk of blockage may be the case where the clothes cover the exhaust grill 50 due to the flow rate of air. Thus, in this case, the RPM may not vary until the primary load size determination operation S330 ends. The flow rate of air may be increased upon judging that there is no risk of blockage. In one example, the flow rate may be increased so as to be close to the maximum flow rate of 2600 RPM. The increase in the flow rate may be performed in a stepwise manner. Thus, in the case where it is determined that there is no risk of blockage, the RPM may be increased in a stepwise manner until the primary load size determination operation S330 ends.

The occurrence of a blockage or the risk of blockage may be judged based on the closing or opening of the airflow switch. When the closing of the airflow switch is sensed within a prescribed time, for example, 10 seconds of an RPM setting period, it may be determined that the exhaust grill 50 is blocked, or is at risk of being blocked. When the airflow switch is not closed within the prescribed time of the RPM setting period, it may be determined that the exhaust grill 50 is not at risk of being blocked. The RPM setting operation may be performed in the same manner regardless of the temperature ranges described above.

Through the RPM setting operation S332, S32' or S332", high-temperature heat and a high flow rate of hot air may be initially supplied. In particular, even if the blockage of the exhaust grill 50 is prevented or the exhaust grill 50 is blocked in the case of an extremely small load, a relatively low flow rate is maintained only for a short time, which may prevent the overload of the heater 33 and the fan motor 35.

Figure 7:
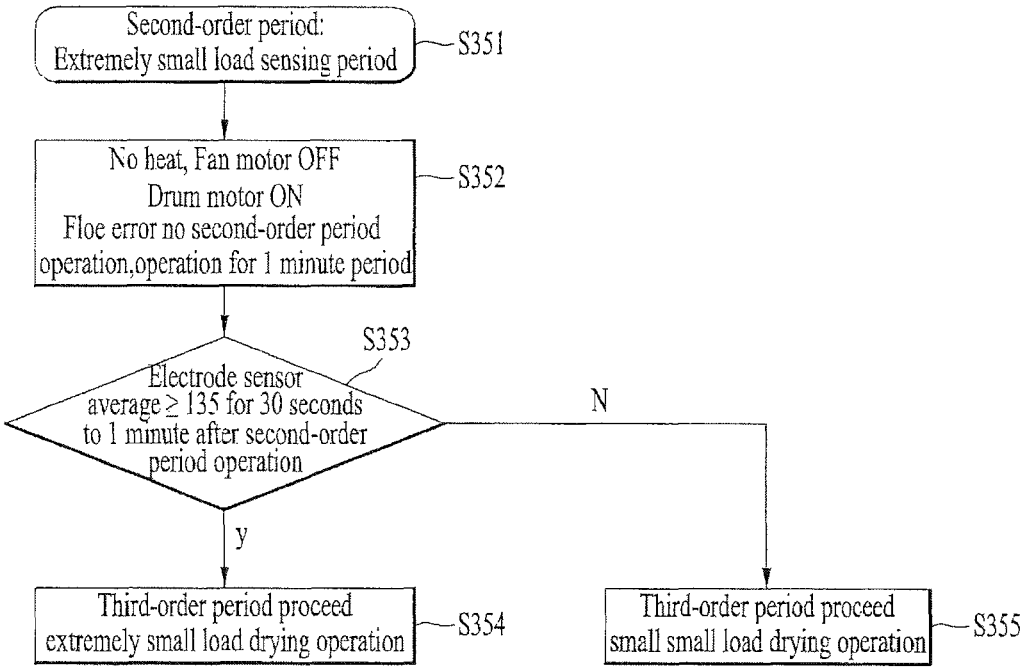
FIG. 7 is a flowchart of one example of a secondary load size determination operation illustrated in FIG. 3.

Hereinafter, the secondary load size determination operation S350 will be described in detail with reference to FIG. 7.

As described above, the secondary load size determination operation S350 is selectively performed when the load is tentatively determined to be a small load in the primary load size determination operation S330. That is, when the load is determined to be a medium or large load in the primary load size determination operation S330, the secondary load size determination operation S350 may be omitted.

Meanwhile, the secondary load size determination operation S350 may be performed using the dryness sensor 60 rather than the temperature sensor 80. That is, a different sensor may be used to determine the load size in the primary load size determination operation S330.

The secondary load size determination operation S350 may be the operation of ultimately determining whether the tentatively determined small load is a small load or an extremely small load. In addition, in the case of an extremely small load, the secondary load size determination operation S350 may be an operation of preventing the clothes from adhering to the exhaust grill 50. When the clothes are already adhered to the exhaust grill 50, the secondary load size determination operation S350 may be an operation of separating the clothes from the exhaust grill 50. Through the secondary load size determination operation S350, it is possible to prevent the clothes from becoming adhered to the exhaust grill 50, and consequently, to prevent errors and thermal damage to constituent elements of the drying machine 100, most particularly thermal damage to the exhaust grill 50.

Specifically, when the second load size determination operation S350 begins (S351), the heater 33 and the fan motor 35 may be controlled so as to be turned off and the drum motor 21 may be controlled so as to be turned on to drive the drum (S352). As such, the clothes may be controlled so as to be tumbled inside the drum without being collected on the front. This tumbling may be performed for a prescribed time, and, for example, may be performed for 1 minute.

The blockage of the exhaust grill 50 using the airflow sensor may not be sensed during the tumbling. This is because the tumbling functions to separate the clothes from the exhaust grill 50 while the exhaust grill 50 is blocked for a short time. That is, it is unnecessary to sense the blockage in the operation of removing the reason for the blockage.

During the tumbling, whether the load is an extremely small load is determined using the electrode sensor 60 (S353). In the case of the extremely small load, the electrode sensor 60 senses a high value. That is, because the volume of clothes containing moisture is small, the frequency with which the clothes come into contact with the electrode sensor 60 is very low. The resistance across the electrode sensor 60, which is the dryness sensor, is very high. The value of the electrode sensor 60 is converted into an average value for a prescribed time, in order to determine whether the load is an extremely small load. In one example, the load is determined to be an extremely small load when the average dimensionless value of the electrode sensor 60 is 135, and the load is determined to be a small load when the average value of the electrode sensor 60 is below 135.

The+ drying S400 is performed based on the load size determined in the secondary load size determination operation S350. The drying in this case may be controlled such that the hot air is supplied at different temperatures and different flow rates between the case of an extremely small load and the case of a small load.

The time required in the secondary load size determination operation S350 may be predetermined. In one example, the secondary load size determination operation S350 may be performed for 1 minute or 2 minutes. The required time is constant regardless of whether the load is an extremely small load or a small load. Accordingly, it is possible to prevent the operating time of the drying machine 100 from being excessively increased due to the secondary load size determination operation S350 in which the supply of hot air is eliminated. In addition, as the secondary load size determination operation S350 is performed for 1 minute or 2 minutes, the load may be satisfactorily determined to be an extremely small load, and the extremely small load adhered to the exhaust grill 50 may be separated therefrom.

As described above, since the fan motor 35 and the drum motor 21 are individually provided, the flow rate of hot air and the driving of the drum may be controlled independently of each other. The drum may be basically controlled so as to rotate at the same RPM in all of the load size determination operations, the drying operation, and the cooling operation. Alternatively, the control of heat in the drying operation may be performed in a different manner from that in the load size determination operations.

First, in the case of an extremely small load, the drying S400 may be performed as hot air is controlled so as to be supplied into the drum at a constant flow rate and in a constant quantity. The fan motor 35, the heater 33, and the modulator 36 may be controlled so that hot air is supplied at a medium flow rate (e.g. 1500 RPM) and in a medium quantity (e.g. 3000 Btu/h). The control of the modulator 36 presupposes variation in the quantity of heat. As such, in the case of an extremely small load, for example, the same value of current may be applied to the modulator 36 so that the opening rate of the modulator 36 does not vary.

In the case of a small load, the drying S400 may be performed as in an extremely small load. However, the quantity of heat and the flow rate of hot air may be increased compared to the case of a small load. In one example, the fan motor 35, the heater 33, and the modulator 36 may be controlled so that hot air is supplied at a flow rate slightly above average (e.g. 2100 RPM) and in a quantity slightly above average (e.g. 3500 Btu/h). The control of the modulator 36 presupposes variation in the quantity of heat. Thus, in the case of the small load, for example, the same value of current may be applied to the modulator 36 such that the opening rate of the modulator 36 does not vary. That is, in the case of an extremely small load and a small load, the control of variation in the opening rate of the modulator 36 may not be performed.

In the case of a medium or large load, the drying S400 may be performed such that the flow rate of hot air and the quantity of heat vary. Control may be performed such that the quantity of heat is increased and the flow rate of hot air is reduced until the initial period, for example, about 10 minutes after the drying S400 begins has passed. This serves to increase the quantity of heat within the drying machine. In other words, this serves to evenly heat the entire system into or from which hot air is supplied or discharged. During this period, the modulator 36 may be controlled such that the opening rate of the modulator 36 is maintained at the maximum value to supply the hot air in the maximum quantity, for example, by 5000 Btu/h. In addition, the flow rate of hot air during this period may be controlled so as to be below the maximum RPM, for example, 3000 RPM. More specifically, the flow rate of hot air may be controlled so as to be 2600 RPM or more.

The supply target quantity of heat and the supply target flow rate of air when the load is determined to be large may be greater than when the load is determined to be small. The supply target quantity of heat and the supply target flow rate of air mean a control target quantity of heat and a control target flow rate of air. The control of the quantity of heat and the flow rate of hot air may be performed throughout the drying operation, or may be performed during most of the drying operation. Meanwhile, as described above, the supply target quantity of heat may vary. In particular, in the case of a medium or large load, the supply target quantity of heat or the control target quantity of heat may vary in the drying operation. However, even if the control target quantity of heat varies in a medium or large load, it may be greater than the control target quantity of heat in an extremely small load and the small load.

Accordingly, excessive drying may be prevented when the load is relatively small. Conversely, both deficient drying and excessive drying may be prevented when the load is relatively large.

After the drying S400 has been performed to some extent, for example, after about 10 minutes have passed, the flow rate of hot air may be controlled to be increased in order to reduce the drying time. That is, it may be desirable to rapidly discharge moisture to the outside of the drying machine 100. The discharge of moisture is very important because the moisture rapidly evaporates during this period. In addition, the opening rate of the modulator 36 may be controlled so as to vary in order to optimize the quantity of heat. The supply quantity of heat may be controlled so as to be increased or reduced based on the temperature of exhaust air.

The control of the flow rate of air may be performed as the drum motor 21 and the fan motor 35 are individually controlled. In addition, the control of the quantity of heat may be performed via a linear valve type electric modulator.

The flow rate of hot air and the quantity of heat in the drying of a medium or large load may be controlled to be higher than the flow rate of hot air and the quantity of heat in a small load or an extremely small load. The control of the quantity of heat may be very advantageous because it reduces both power consumption and drying time. Of course, the control of the quantity of heat may be performed via factors sensed by the temperature sensor 80 and the dryness sensor 60.

Drying may be performed as different flow rates and heat quantities are supplied based on the load size. In this way, optimal drying and optimal energy efficiency may be realized regardless of the load size.

When the drying S400 ends, the cooling S500 is performed. The cooling S500 may be performed directly after the drying S400 ends. The cooling S500 may be an operation of driving the drum while supplying cold air. Thus, the temperature of clothes may be primarily reduced and the temperature of the drying machine system may be secondarily reduced.

As described above, in the control method of the drying machine 100 the flow rate control RPM may be different based on the load size. In particular, the control flow rate RPM may be controlled as the size of the load increases. In one example, the flow rate may be controlled to 3000 RPM for a medium or large load, to 2100 RPM for a small load, and to 1500 RPM for an extremely small load.

In the control method of the drying machine 100 the flow rate control RPM during the cooling S500 may be controlled to be the same as the flow rate control RPM during the previous drying S400.

Figure 8:
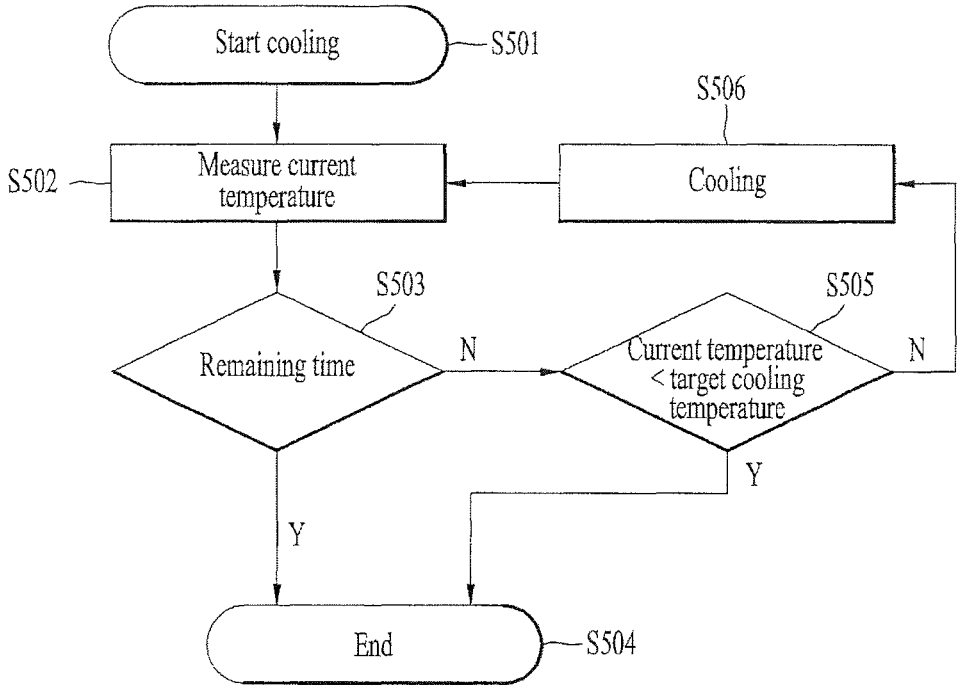
FIG. 8 is a flowchart of one example of a cooling operation illustrated in FIG. 3.

The cooling S500 will be described in more detail with reference to FIG. 8.

When the drying S400 ends, the control method enters the cooling S500 (S501), and the current temperature is measured (S502). That is, the temperature of the drying machine system is measured via the temperature sensor 80. Then, whether a predetermined time required to perform the cooling S500 has passed is determined (S503). That is, whether the remaining time is zero is determined.

When the remaining time is zero, the cooling S500 ends (S504). In addition, when some time remains, the measured current temperature and a target cooling temperature are compared with each other (505). When the current temperature is lower than the target cooling temperature, the cooling S500 ends (S504).

When time remains and the current temperature is higher than the target cooling temperature, the cooling S500 is performed via the supply of cold air (S506). That is, the cooling S500 may begin immediately, or may be continued.

The control flow rate RPM in the beginning of the cooling and/or the implementation of the cooling S506 may not be predetermined, and may be controlled to a previous flow rate control RPM. For example, when the drying ends at 1500 RPM, the flow rate control RPM in the cooling may be 1500 RPM. In addition, when the drying ends at 3000 RPM, the flow rate control RPM in the cooling may be 3000 RPM. Accordingly, the generation of shock noises may be prevented as the RPM of the fan motor is maintained upon the transition from drying to cooling. In this way, it is possible to prevent the user from wondering about the failure of the drying machine.

Hereinafter, the user interface 200 of the drying machine 100 in accordance with the embodiment of the present invention will be described in detail with reference to FIG. 9.

Figure 9:
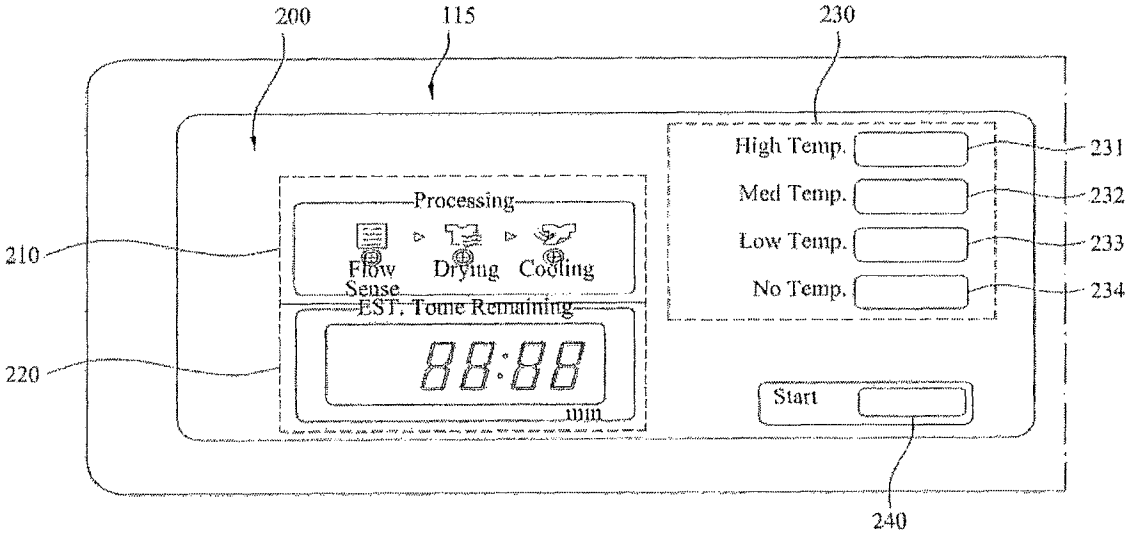
FIG. 9 is a partial flow view illustrating one example of the front surface of a control panel illustrated in FIG. 1.
Figure 10:
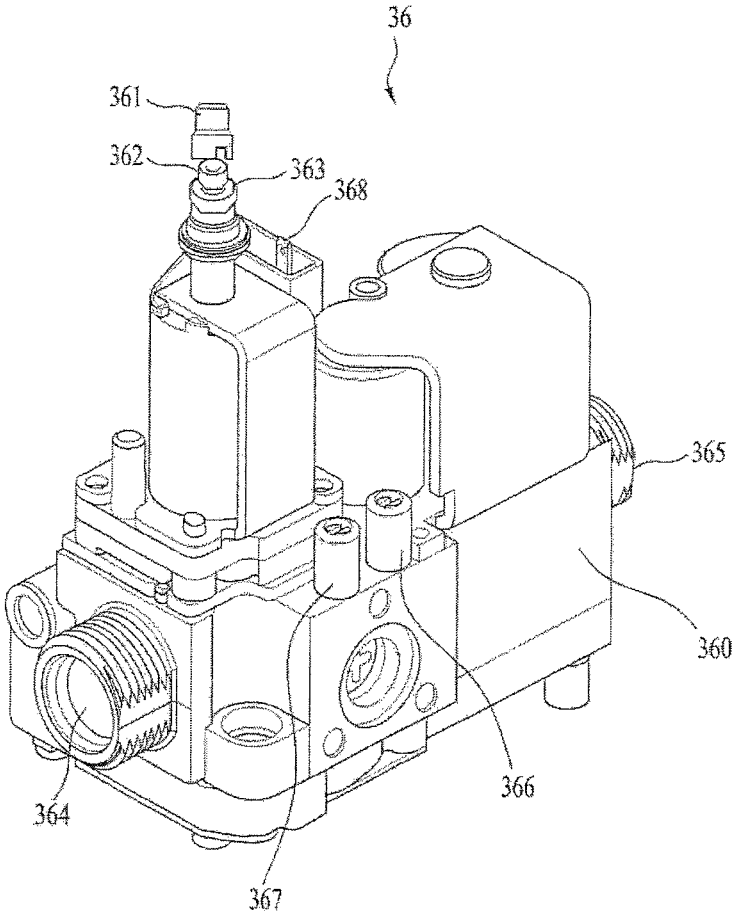
FIG. 10 is a perspective view illustrating one example of a modulator illustrated in FIG. 1.

As illustrated in FIG. 9, a variety of buttons or a display for the user interface 200 may be provided on the front surface of the control panel 115 illustrated in FIG. 1. The user interface 200 may be controlled via the controller 10, and the controller 10 may control the operation of the drying machine 100 based on information input via the user interface 200.

First, a state LED 210 may be provided. With this state LED 210, the user may check whether a duct is blocked, or the drying operation that is being performed. Course or cycle buttons 230 may be provided. The buttons 230 may be provided for respective courses or cycles. In one example, a high temperature course button 231, a medium temperature course button 232, a low temperature course button 233, and a heat elimination course button 234 may be provided. These buttons may be provided to allow the user to select a corresponding course. However, as will be described below, at least one of the buttons 231, 232, 233 and 234 may be used to begin a user menu or a service menu.

A display LED 200 may be provided. With this display LED 200, the time remaining in the drying course to be performed may be displayed. The display LED may be provided to display a four-digit number. The display LED 220 may be used to change a program factor after the service menu, which will be described below, is initialized.

A start button 240 may be provided to commence drying, the course of which is selected.

When the user selects a specific course via the course button 230 and inputs a start command via the start button 240, the controller 10 performs the drying based on the selected specific course.

The modulator 36 may include a body 360, and the body 360 may be provided at one side thereof with an inlet 365 and at the other side thereof with an outlet 365. After gas is introduced through the inlet 365, the gas is discharged through the outlet 365. The discharged gas is introduced into the heater. The higher the pressure of discharged gas, the greater the quantity of heat generated by the heater.

Various elements to adjust the pressure of gas may be provided on the body 360.

First, a pressure checking hole 366 may be provided to check the inlet gas pressure. The pressure checking hole 366 may be provided with a screw, and a pressure gauge may be inserted into the pressure checking hole 366 when the screw is loosened. Thereby, the inlet gas pressure may be checked.

In addition, a pressure checking hole 367 may be provided to check the outlet gas pressure. The configuration and the pressure checking method of the pressure checking hole 367 may be the same as in the inlet gas pressure.

When the inlet gas pressure and the outlet gas pressure are checked, the outlet gas pressure may be adjusted. The pressure of gas supplied to the heater 33 may be adjusted. The adjustment in the pressure of gas may be performed as the opening rate of the modulator 36 is mechanically adjusted.

The body 360 may be provided with elements to adjust the gas pressure. A maximum pressure setting nut 363 and a minimum pressure setting nut 362 may be provided to adjust the gas pressure. In addition, the minimum pressure setting nut 362 and the maximum pressure setting nut 361 may be located at upper and lower positions, and a protective cap 361 may be provided to protect the nuts 362 and 361.

In order to adjust the gas pressure, the user may first remove the protective cap 361 and tighten or loosen the maximum pressure setting nut 363. The tightening of the nut 363 reduces the maximum opening rate, thus causing a reduction in the maximum pressure. Conversely, loosening the nut 363 increases the maximum opening rate, thus increasing the maximum pressure.

In addition, the user may tighten or loosen the minimum pressure setting nut 362. In this way, the minimum opening rate may be increased or reduced. Reduction in the minimum opening rate reduces the minimum pressure, and increase in the minimum opening rate increases the minimum pressure.

That is, the maximum pressure and the minimum pressure may be set differently using the nut 363. The maximum pressure setting and the minimum pressure setting are performed at the site of manufacture of the drying machine, and it is not easy to adjust the maximum pressure setting at the site at which the drying machine 100 is actually used. This is because these settings require disassembly of the panels of the drying machine 100 and sufficient working space.

There is a problem in that the pressure of external gas, i.e. the pressure of external gas supplied to the drying machine 100 is not constant. In addition, even if the pressure of external gas is constant, the pressure of gas that is actually supplied to the heater may vary due to variation in the modulator 36.

As described above, the modulator 36 may be a gas valve, the opening rate of which varies in proportion to the value of current or a voltage applied to the electric modulator. In addition, the electric modulator includes no device for manually adjusting the gas pressure. That is, there is no device for manually adjusting only the maximum pressure and the minimum pressure and no device for manually adjusting pressure values between the maximum pressure and the minimum pressure. Thus, it is necessary to manually adjust the opening rate of the modulator 36.

The modulator 36 basically includes a connection terminal 368. The gas supply pressure may be controlled between the maximum pressure value and the minimum pressure value as a voltage or current applied to either end of the connection terminal 368 is adjusted.

There is a problem in that, for example, when a constant voltage is applied, it is difficult to provide the same opening rate, i.e. the same gas pressure. This may be caused by deviation of the modulator 36. There is a risk that a target gas pressure may not be satisfied due to, for example, deviation of electromagnetic force caused by the inner coil of the modulator 36 or the mechanical tolerance of the valve.

For example, the modulator 36 may be basically programmed to apply a voltage of 16.5V to either end of the connection terminal 368 for the supply of the maximum heat (5000 Btu/h) and a voltage of 8.24V for the supply of the medium heat (2500 Btu/h).

That is, the controller 10 may control the supply of a voltage, which corresponds to a required value of heat, to the modulator 36. A lookup table of the heat value and the voltage value may become inaccurate due to variation in the modulator 36.

The modulator 36 is not sufficiently controlled by a heat quantity value indicated by the controller 10 (via the application of a predetermined voltage value). In one example, the opening rate may be increased so that quantity of heat becomes greater than the indicated heat quantity value, or conversely may be reduced so that the quantity of heat quantity smaller than the indicated heat quantity value.

In some examples, a drying machine capable of minimizing variation in the electric modulator is provided. In addition, the drying machine capable of manually adjusting the supply pressure via the modulator is provided. Manual adjustment of the opening rate of the modulator must be possible only for the manager. That is, this adjustment may be difficult for the general user.

In some examples, a drying machine, which enables adjustment of the opening rate of the modulator via a manager menu, consequently optimally adjusting the heat quantity, is provided.

The manager menu may be initialized in various ways. It may be possible to initialize the manager menu via a toggle switch (provided at a position that is difficult for a general user to access) provided in the drying machine 100. In addition, the initialization and use of the manager menu may be possible via the user interface 200. At this time, a specific use method, rather than a general use method, may be adopted. Of course, it is possible to initialize the manager menu by inputting a service card.

As illustrated in FIG. 9, it is possible to initialize the manager menu by pushing the high temperature course button 231 and the low temperature course button 233 at the same time. In a more complicated manner, it is possible to initialize the manager menu by pushing the medium temperature course button 232 three times after pushing the high temperature course button 231 and the low temperature course button 233 at the same time. That is, it is possible to initialize the manager menu via the user interface in the form of a hidden key or a hidden button.

When initializing the manager menu, a specific mark may be displayed on the display LED 220. The initialization of the manager menu may be checked via the display of the specific mark.

The display LED may have various shapes. In place of the LED display 220, an LCD display may be used. In the present embodiment, the display LED 220 is so named because the display includes LEDs. Thus, this may be more generally referred to as a display, and the display may be designated by the same reference numeral 220.

The display 220 may be provided to display the remaining operating time of the drying machine 100. That is, the display 220 may be provided to display the time remaining in a course. The display 220 may be divided into four sections to display the hour and the minute as a four-digit number. With this display 220, combinations of various characters or numbers may be displayed. That is, the display may show only the remaining time to the general user, and the user may check the remaining time. However, in the manager menu, appointed specific characters or numbers, and combinations thereof may be displayed. The manager may easily use the manager menu by viewing the characters or numbers.

After beginning the manager menu, it is possible to enter a menu for adjusting the modulator 36 to a desired opening rate by appropriately pushing the buttons. In addition, the opening rate of the modulator 36 may be adjusted by appropriately pushing the buttons while viewing specific marks displayed on the display LED 220. In other words, a predetermined voltage value or current value may be changed. Of course, the voltage value or the current value may be changed in a pulse value form.

For example, when the opening rate of the modulator 36 is greater than a reference value, the voltage value may be reduced via the manager menu. Conversely, when the opening rate of the modulator 36 is smaller than the reference value, the voltage may be increased via the manager menu.

Specifically, based on a table containing a plurality of heat quantity values and voltage values corresponding to respective heat quantity values, when the opening rate of the modulator 36 is greater than the reference value, the respective voltage values may be reduced by a predetermined decrement. The voltage values may be increased by a predetermined increment. In other words, a new table or a corrected table may be made via the manager menu. In this way, accurate control of the quantity of heat may be performed despite variation in the modulator 36.

The effect of variation in the modulator 36 may be checked by measuring the outlet gas pressure described above. For example, the outlet gas pressure may be measured at a point in time at which the maximum quantity of heat is required. It can be appreciated that the opening rate is greater than the reference value when the outlet gas pressure is greater than a reference value, and that the opening rate is smaller than the reference value when the outlet gas pressure is smaller than a reference value.

As described above, the control method of the drying machine 100 implements the control of the quantity of heat via the opening rate of the modulator 36. Thus, the opening rate of the modulator 36 may be adjusted to suit the set quantity of heat. In this way, excessive drying and deficient drying may be prevented, and energy consumption may be reduced.

Although the exemplary implementations have been illustrated and described as above, of course, it will be apparent to those skilled in the art that the implementations are provided to assist understanding of the present disclosure and the present disclosure is not limited to the above described particular implementations, and various modifications and variations can be made in the present disclosure without departing from the spirit or scope of the present disclosure, and the modifications and variations should not be understood individually from the viewpoint or scope of the present disclosure.

What is claimed is:

1. A method of controlling a drying machine, comprising:

a first load decision step for determining, based on a rate of the variation in a temperature of air discharged from a drum, whether a load of clothes accommodated in the drum is a first load size, a second load size, or a third load size, wherein the variation in temperature of air is sensed by a temperature sensor, hot air is supplied to the drum by driving of the drum, a heater, and a fan motor, the third load size is larger than the first load size and the second load size, and the second load size is larger than the first load size;

a second load decision step for determining whether the load of clothes is the first load size or a fourth load size smaller than the first load size using a dryness sensor provided in the drum while the supply of hot air and the driving of the drum has been stopped, the second load decision step being selectively performed after the first load decision step based on the load being determined to be the first load size in the first load decision step; and a drying step for performing drying based on the determined load size in the first load decision step or the second decision step, wherein the first load decision step comprises determining that the load of clothes is the second load size or the third load size based on the rate of the variation in the temperature of air being less than a first threshold value, wherein the first load decision step comprises determining that the load of clothes is the first load size based on the rate of the variation in the temperature of air being greater than or equal to the first threshold value, wherein the second load decision step comprises determining that the load of clothes is the fourth load based on a frequency of the clothes contact with the dryness sensor being greater than or equal to a reference value, and wherein the second load decision step comprises determining that the load of clothes is the first load size based on the frequency of the clothes contact with the dryness sensor being less than the reference value.

2. The control method according to claim 1, wherein the supply quantity of heat of the heater and the RPM value of the fan motor are controlled to be constant in the drying step based on the load of clothes being determined to be a first load size or the fourth load size, and wherein the supply quantity of heat of the heater and the RPM value of the fan motor are controlled to vary in the drying step based on the load of clothes being determined to be the second load size or the third load size.

3. The control method according to claim 1, further comprising an initial temperature sensing step for sensing a temperature using the temperature sensor before the first load decision step, wherein the driving of the heater is stopped and the fan motor and the drum are driven in the initial temperature sensing step.

4. The control method according to claim 3, wherein the first load decision step is performed based on the initial sensed temperature in the initial temperature sensing step being a predetermined temperature or lower than the predetermined temperature, wherein the initial temperature sensing step is repeated for a predetermined time based on the initial sensed temperature in the initial temperature sensing step exceeding the predetermined temperature, and wherein, while the initial temperature sensing step is repeated, the first load decision step is performed based on the initial sensed temperature being the predetermined temperature or lower, and the first load decision step is not performed and the second load decision step is performed based on the initial temperature exceeding the predetermined temperature, wherein the predetermined time is a time to perform a temperature drop when cool air is supplied even if the initial sensed temperature is the highest temperature range and the load of the clothes is of the third load size, and wherein the predetermined time is a time to perform a temperature drop when cool air is supplied even if the initial sensed temperature is in a highest temperature range and the load of the clothes is of the third load size.

5. The control method according to claim 4, wherein the initial temperature sensed during first load decision step is categorized into any of a plurality of temperature ranges, wherein the initial temperature is the lowest temperature in the highest temperature range among the plurality of temperature ranges.

6. The control method according to claim 1, wherein the first load decision step includes a RPM setting step for setting the RPM of the fan motor to an increased value.

7. The control method according to claim 6, wherein the RPM stetting step is performed to increase the RPM in a stepwise manner.

8. The control method according to claim 1, wherein the supply quantity of heat of the heater is controlled to be maximum in the first load decision step.

9. The control method according to claim 1, further comprising a duct blockage sensing step for sensing duct blockage using an airflow switch, wherein the duct blockage sensing step is eliminated in the first load decision step and the second load decision step, and is performed in performing the drying step.

10. The control method according to claim 1, further comprising a cooling step for supplying cold air into the drum by driving the drum and the fan motor after the drying step ends, and wherein the fan motor is controlled to be operated at a previous RPM in cooling step.

* * * * *